US006805606B1

(12) United States Patent
Kellum

(10) Patent No.: US 6,805,606 B1
(45) Date of Patent: Oct. 19, 2004

(54) INFLATABLE EXPANDING DOLL

(76) Inventor: Freddie Lee Kellum, 4538 N. Clark St. Apt. 304, Chicago, IL (US) 60640

( * ) Notice: Subject to any disclaimer, the term of this patent is extended or adjusted under 35 U.S.C. 154(b) by 0 days.

(21) Appl. No.: 10/680,910

(22) Filed: Oct. 8, 2003

(51) Int. Cl.[7] ..... A63H 29/10; A63H 33/40

(52) U.S. Cl. ..... 446/176; 446/226; 446/320; 92/92

(58) Field of Search ..... 446/220, 221, 446/223, 224, 226, 320, 330, 373, 376, 379, 352–354, 375, 390, 176; 92/89–92, 48; 40/212, 213, 215, 412, 422

(56) References Cited

U.S. PATENT DOCUMENTS

| | | | | | |
|---|---|---|---|---|---|
| 2,047,377 | A | * | 7/1936 | Liwschutz | 40/455 |
| 2,503,948 | A | * | 4/1950 | Henry | 446/226 |
| 2,731,768 | A | * | 1/1956 | Harrowe | 446/226 |
| 4,055,020 | A | | 10/1977 | Kosicki | |
| 4,242,830 | A | | 1/1981 | Hauser | |
| 4,268,991 | A | | 5/1981 | Cotey | |
| 4,895,546 | A | | 1/1990 | Rakonjac | |
| 5,052,683 | A | * | 10/1991 | Wang et al. | 482/7 |
| 5,340,350 | A | | 8/1994 | Fink | |
| 5,380,234 | A | | 1/1995 | Ledford | |
| 5,419,729 | A | * | 5/1995 | Gross | 446/183 |
| 5,474,485 | A | * | 12/1995 | Smrt | 446/199 |
| 5,516,322 | A | | 5/1996 | Myers | |
| 5,664,983 | A | * | 9/1997 | Hollis | 446/199 |
| 6,030,271 | A | | 2/2000 | Pietrafesa | |
| 6,568,984 | B1 | * | 5/2003 | Applewhite | 446/176 |

* cited by examiner

*Primary Examiner*—Jacob K. Ackun
*Assistant Examiner*—Bena B. Miller

(57) ABSTRACT

An inflatable doll action figure having a telescopically extendable endoskeleton surrounded by an inflatable skin, associated with a manually operated air pump and release valve for selectively expanding and contracting individual air chambers, which form the doll's torso and limbs to simulate growth into a physically developed figure, and return to its original undeveloped state. The doll and its individual parts are protected from over-expansion by limit stops on axial movement of individual limbs of the telescopic skeleton, and circumferential limits on the individual inflatable chambers forming the limbs and muscles of the doll. The limits can be either molded into the inflatable skin, or incorporated into a separate fabric covering simulating clothing for the doll. The individual chambers are provided with orifices for filling and emptying from a conduit, with a one-way valve plug positioned to automatically block each orifice when its associated air chamber has reached a predetermined maximum expansion, while allowing air to escape the chamber during selective deflation of the doll. A pair of limbs may be provided with off-axis limit stops on axial movement whereby at the limits of axial extension the limbs are urged toward each other to simulate a hugging motion.

7 Claims, 2 Drawing Sheets

INFLATABLE EXPANDING DOLL

CROSS-REFERENCE TO RELATED APPLICATIONS (Not Applicable)

BACKGROUND OF THE INVENTION

1. Field of the Invention

This invention relates to dolls or action figures, and more particularly to a doll that is inflatable.

2. Description of the Related Art

Dolls and toys that can be inflated to change their size and shape are well known in the art. Some of these include:

U.S. Pat. No. 5,380,234 to Ledford (Jan. 10, 1995) describes an inflatable combatant action toy with an inflatable bladder within a flexible body and pivotal arms configured to deliver a simulated "punch" to another similar toy.

U.S. Pat. No. 5,664,983 to Hollis (Sep. 9, 1997) describes an action figure with an expandable torso. Expansion of the torso creates a partial vacuum within the torso causing the overlying skin to conform more closely to the torso, thereby giving the appearance of enhanced muscular definition.

U.S. Pat. No. 5,419,729 to Gross (May 30, 1995) describes toy figures having inflatable bladders which can simulate weight gain or muscular development.

However, these prior art toys and action figures devices have no means for limiting the physical expansion of the toy beyond a set limit, and no means for limiting the allowable pressure within the toy so that its physical limits of strength are not exceeded. Also, the expandable portions of these prior art toys simply grow in a uniform or generally isotropic manner, with all portions of the toy growing at more or less the same rate, so that the relative physical positions of the toy remain substantially the same.

BRIEF SUMMARY OF THE INVENTION

The present invention is a selectively inflatable doll comprising a flexible endoskeleton with telescopically extendable limbs, a stretchable inflatable skin supported by and covering the endoskeleton, an air pump and a release valve. The skin is comprised of a series of connected chambers, each chamber with an orifice for inflation and deflation from a conduit. A thumb-operated air pump is connected to the conduits and provides an easy means to inflate the doll. A pressure relief valve is connected to one of the conduits.

The invention has built-in limit stops for preventing inflation and extension beyond set limits both axially and radially. The telescopically extendable limbs have internal axial stop means, much like a telescopic radio antenna, to prevent extension beyond a predetermined point of longitudinal extension. In an alternate embodiment of the invention, additional axial stop means are provided which limit the axial expansion of the limb on one side only, which as the limb approaches the limits of expansion, it is urged in a lateral direction, simulating natural sideways movement of the limb.

In addition, the invention provides two means for limiting radial extension. First, the skin is surrounded by a layer of flexible interconnected fibers which serve as a circumferential limit stop means for limiting excessive radial expansion. Second, certain of the chambers of the skin have inflation orifices fitted with limit plugs for preventing over-inflation of the chambers. The plugs are retained by the endoskeleton and protrude through openings within the skin. When the maximum radial expansion of the skin is reached, the plugs seal off the chamber, preventing any further air from being pumped into that space.

In view of the foregoing, it is a principal object of this invention to provide an inflatable doll with built-in limits for preventing over-expansion beyond pre-set limits.

It is also an object of this invention to provide an inflatable doll which can be inflated by the use of a thumb-operated air pump.

It is an additional object of the invention to provide such a doll with at least one pair of limbs in which the limits of expansion are off-set from the central axis of the limb, so that upon reaching the limits of axial expansion the limbs are urged in a converging lateral direction, whereby the doll's arms appear to move as if it were "hugging" something.

DETAILED DESCRIPTION OF THE INVENTION

Figure 1:
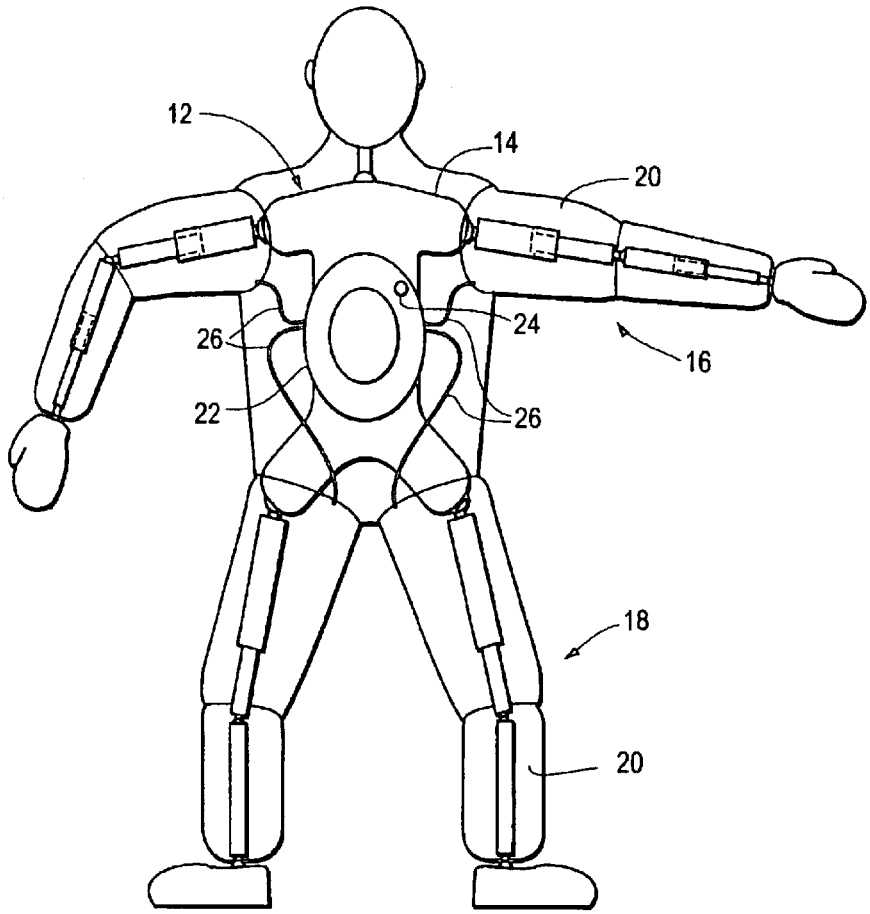
FIG. 1 is an x-ray view of the inflatable doll of the present invention showing the air pump and conduits for inflating the connected chambers of the inflatable skin. The chambers are shown surrounding one of the legs.

Turning to the drawings, there is shown in FIG. 1 an inflatable doll 10 comprising a flexible endoskeleton or armature 12 with a torso 14 and articulated connected limbs including arms 16 and legs 18. The telescopic limbs have ball and socket joints at the shoulders, elbows and knees.

The telescopic limbs are self-limiting in their expansion, much like the extendable antenna of a portable radio. These telescopic limbs can be extended in a longitudinal direction from a minimal state when the doll is deflated, to a maximal state when the doll is fully inflated. The limits of this axial extension may be set by an internal stop within the telescopic extension means.

The external surface of the doll consists of a resiliently stretchable inflatable skin 20 which covers the torso 14, the arms 16 and legs 18. The endoskeleton components support the skin 20 so that in the deflated condition, the skin 20 simulates a physically undeveloped figure, but when inflated, it simulates a fully developed and muscular figure.

A thumb-operated air pump 22 located in the abdomen area of the torso 14 allows for easy selective inflation of the doll 10. Inflating the doll simulates growth of the doll from a physically undeveloped figure to a physically developed figure.

Each limb of the doll includes within the skin 20 a series of connected air chambers. For example, FIG. 1 shows that each leg of the figure comprises separate chambers for the foot, the lower leg, and the thigh, all linked by the articulated telescoping armature or endoskeleton. Similarly, each arm of the figure comprises separate chambers for the hand, forearm, upper arm, and trunk.

Conduits 26 interconnect the air pump 22 and each of the chambers. Suitable air hoses connect from the pump to each of the of the legs and arms, terminating in an inlet opening or orifice into which the conduit 26 fits to allow air to be pumped into the chamber for inflation, or to pass back out of the chamber for deflation. When the doll is in its uninflated state, a series of thumb strokes on the pump 22 sends air into the limbs, causing them to expand extend, simulating muscular growth. To bring the doll back to its original size again, a pressure relief valve 24 is connected to the conduit above the thumb-operated pump 22. Deflating the doll using the pressure release valve 24 returns the doll from its inflated physically developed figure back to its original shape as a physically undeveloped figure.

Figure 2:
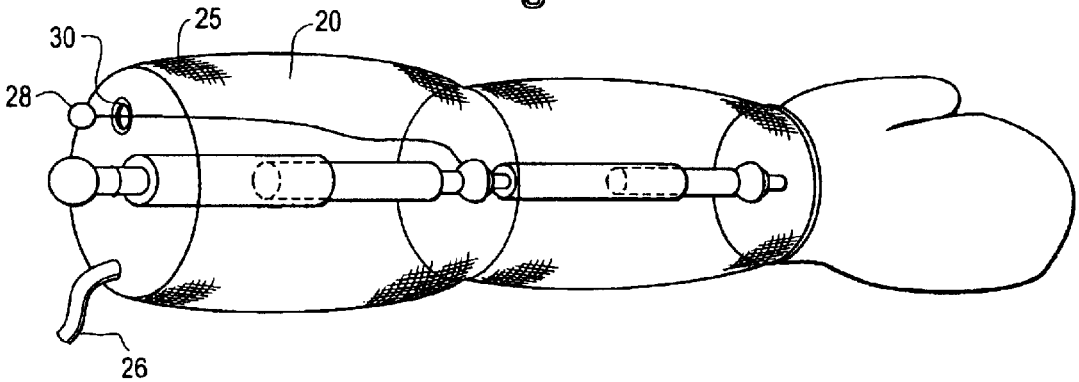
FIG. 2 is an x-ray view in partial perspective of one arm of the inflatable doll of the present invention showing the layer of flexible interconnected fibers surrounding the chambers of the inflatable skin, and also showing the plug retained by the exoskeleton.
Figure 3:
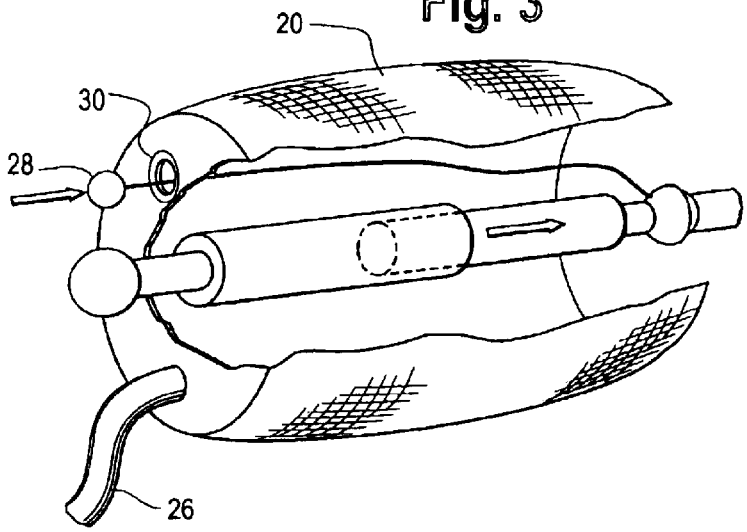
FIG. 3 is a detail partial perspective of the arm of FIG. 2 showing an inflation port in the arm air about to be closed by its corresponding limit plug, which is in turn tethered to the arm's expanding telescopic armature.

As a feature of the invention, the limbs of the doll of the present invention have circumferential limit stop means to create a desired shape for the limbs of the fully inflated doll, and to prevent damage which might otherwise be caused by radial over-expansion of the chambers beyond a predetermined maximum radial limit. As shown in FIG. 2, the invention provides a first expansion limiting means comprising a layer of flexible interconnected fibers 25 surrounds the skin 20 like a mesh sweater, creating a physical barrier beyond which the chamber cannot expand. The layer of interconnected fibers 25 can be incorporated into decorative materials to simulate clothing for the doll 10.

As shown in FIG. 2, the invention also provides a second circumferential limit stop means consisting of a captive poppet valve 28 tethered to part of the extensible telescopic armature or endoskeleton 12. The valve 28 protrudes through an opening or socket 30 in the flexible wall 20 of the chamber. As the chamber inflates with air, the skin 20 of each chamber expands radially and the plug 28 is gradually drawn into the opening 30 until the opening is closed off entirely when the predetermined maximum radial expansion is reached. When the doll is deflated, the decreased tension on their tethers causes the plugs 28 to loosen to allow air to escape from the chambers.

Figure 4A:
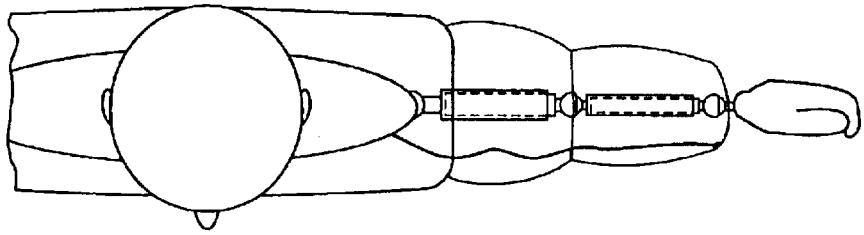
FIG. 4 is a view looking downward at the head, shoulder and arm of inflatable doll of the present invention showing the limit stops of axial movement are off-axis and opposed to one another, thereby imparting a converging or closing "hugging" motion to the arms as the doll approaches full inflation.
Figure 4B:
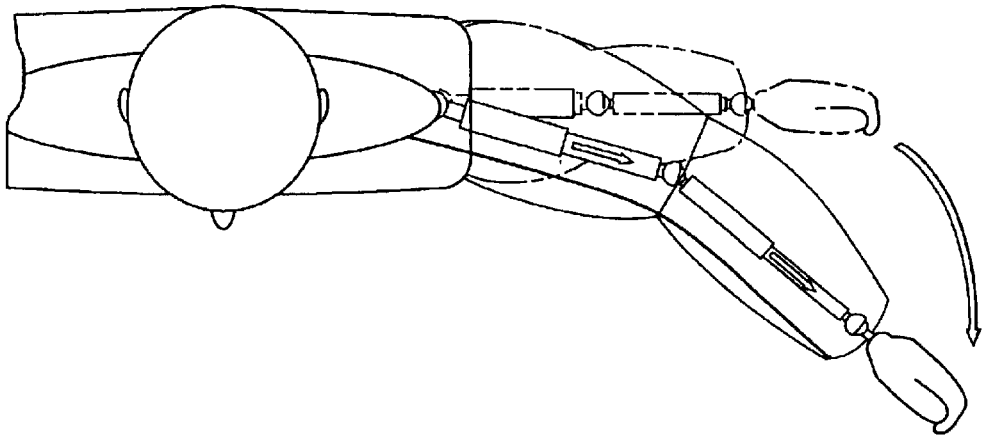

As shown in FIG. 4, and according to another feature of the invention, the doll can be endowed with the ability to "hug" by providing one pair of limbs (the arms) with off-axis limit stops on the telescopic axial movement of the armature, whereby when the articulated arms reach their limits of axial extension, they are urged toward each other in what simulates a hugging motion.

Other embodiments of the invention are contemplated which do not depart from the scope of the invention claimed. While the preferred form of the invention has been shown and described herein, it is to be understood that the invention is not to be taken as limited to the specific form described herein, and that changes and modifications may be made without departing from the true concept of the invention. It is therefore contemplated that the foregoing teachings and the appended claims define the present invention and any and all changes and modifications.

I claim as my invention:

1. An action figure doll which is selectively inflatable to simulate growth comprising:

a) A flexible endoskeleton comprising a torso and articulated connected limbs, at least one of the limbs being telescopically extendable from a minimal state to a maximal state;

b) A resiliently stretchable inflatable skin supported by and covering the endoskeleton in the minimal state to simulate a physically undeveloped figure; and c) Air pump and release means for selectively inflating and deflating the skin to simulate growth of the doll into a physically developed figure and its return to a physically undeveloped state.

2. The doll of claim 1 in which each telescopically extendable limb has axial limit stop means for preventing extension along a longitudinal axis beyond a predetermined limit of longitudinal extension, and the inflatable skin includes radial limit stop means for preventing radial expansion beyond a predetermined limit of radial expansion.

3. The doll of claim 2 in which the radial stop limits consist of flexible interconnected fibers surrounding the inflatable skin.

4. The doll of claim 2 in which the fibers are incorporated into simulated clothing for the doll.

5. The doll of claim 2 in which the axial limit stop means of at least one pair of extendable limbs is positioned off-axis to the direction of extension, whereby at the limit of extension of each said limb each stop means exerts a radial biasing force on its respective limb, thereby causing said pair of extendable limbs to be urged together.

6. An action figure doll which is selectively inflatable to simulate growth comprising:

a) A flexible endoskeleton comprising a torso and articulated connected limbs, at least one of the limbs being telescopically extendable from a minimal state to a maximal state;

b) A resiliently stretchable inflatable skin supported by and covering the endoskeleton in the minimal state to simulate a physically undeveloped figure, the skin comprising a series of connected chambers, each chamber having an orifice for inflation and deflation from a conduit;

c) Air pump and release means connected to the conduit for selectively inflating and deflating the skin to simulate growth of the doll into a physically developed figure and its return to a physically undeveloped figure; and d) Each chamber having valve means responsive to the expansion of the chamber to a predetermined maximum dimension for sealing the orifice to prevent overinflation of the chamber.

7. The doll of claim 5 in which the valve means includes a plug retained by the endoskeleton and cooperating with an opening whereby the inflation and radial expansion of its associated chamber beyond the predetermined maximum dimension serves to draw the plug into its associated opening to seal the chamber against further inflation.

* * * * *